US005884999A

United States Patent [19]

Muzzio et al.

[11] Patent Number: 5,884,999

[45] Date of Patent: Mar. 23, 1999

[54] METHOD AND APPARATUS FOR MIXING PARTICULATE SOLIDS WITH ROCKING AND ROTATIONAL MOTION

[75] Inventors: Fernando J. Muzzio, Monroe; Richard E. Riman, Belle Mead; Carolyn Wightman, Edison, all of N.J.; Paul R. Mort, Wyoming, Ohio

[73] Assignee: Rutgers University, Piscataway, N.J.

[21] Appl. No.: 695,477

[22] Filed: Aug. 12, 1996

[51] Int. Cl.[6] ..... B01F 9/02; B01F 9/08

[52] U.S. Cl. ..... 366/219; 366/224; 366/233

[58] Field of Search ..... 366/53–56, 60, 366/219, 220, 235, 239, 233, 224, 348

[56] References Cited

U.S. PATENT DOCUMENTS

| | | | |
|---|---|---|---|
| 2,514,126 | 7/1950 | Fischer . | |
| 2,656,162 | 10/1953 | Fischer et al. . | |
| 2,677,534 | 5/1954 | Fischer et al. . | |
| 2,908,487 | 10/1959 | Fischer . | |
| 4,283,148 | 8/1981 | Peterson | 366/220 X |
| 4,491,415 | 1/1985 | Bishop . | |
| 4,571,089 | 2/1986 | Gudlauski et al. | 366/235 X |

FOREIGN PATENT DOCUMENTS

| | | | |
|---|---|---|---|
| 709003 | 5/1954 | United Kingdom | 366/235 |
| 1033733 | 6/1966 | United Kingdom | 366/235 |

OTHER PUBLICATIONS

Shinnar et al. A Test of Randomness For Solid–Solid Mixtures pp. 220–229 (1961).

Lin et al. "Assessment of The Uniformity of Composition" pp. 1–18 (1986).

K.W. Carey "The Mixing of Solids In Tumbling Mixtures" 191–199 (1964).

D.C. Cahn et al. "Nature" pp. 494–496 (1966).

M. Alonso et al. "Influence of Rocking Motion on Mixing Powders" pp. 65–67 (1989).

M. Liu et al. "Quantification of Mixing in Aperiodic Chaotic Flows" pp. 869–893 (1994).

D.J. Lamberto et al. "Using Time–Dependent RPM To Enhance Mixing In Stirred Vessels" pp. 733–741 (1995).

Wightman et al. "A Quantitative Image Analysis Method For Characterizing Mixtures of Granular Materials" (1995).

*Primary Examiner*—Charles E. Cooley

*Attorney, Agent, or Firm*—Mathews, Collins, Shepherd & Gould, P.A.

[57] ABSTRACT

A method and apparatus for improved particulate mixing in which rotational motion of a mixing vessel is periodically disrupted by rocking motion. A vessel rotates around a central axis for producing the rotational motion. The vessel is rocked in a direction substantially perpendicular to the central axis for producing rocking motion. Mixing is enhanced when the rocking frequency is different than the rotational frequency.

27 Claims, 2 Drawing Sheets

METHOD AND APPARATUS FOR MIXING PARTICULATE SOLIDS WITH ROCKING AND ROTATIONAL MOTION

This invention was made with Government support Grant LTS-930-773 SGE awarded by the National Science Foundation. The Government has certain rights in this invention.

BACKGROUND OF THE INVENTION

1. Field of the Invention

This invention relates to a method and apparatus for improved particulate mixing in a vessel rotating about its central axis and rocking in a direction perpendicular the central axis.

2. Description of the Related Art

Dry particulate mixing is a basic operation frequently used in a wide variety of industrial applications, such as food, agricultural products, cosmetics, coal, cement, pharmaceuticals, chemicals, plastics, and ceramics. Conventionally, the success of solids mixing operations has been evaluated in terms of ultimate product quality. Inadequate mixing during the production sequence can result in rejection of the finished product due to poor quality. If mixing insufficiencies can be identified and avoided during the manufacturing process, fewer batches would be rejected, thus reducing both waste and manufacturing costs.

One solution describes identifying the particular mixture with a solidification technique to preserve the mixture structure in an undisturbed state. As described by Shinnar et al. in "A Test Of Randomness For Solid-Solid Mixtures", *Chemical Engineering Science*, Vol. 15, pp. 220–229 (1961), samples are solidified with molten wax and surface samples are produced by slicing the solidified sample with a microtome. Thereafter, observation and analysis of flow patterns can be determined from the solidified structure.

In another approach, binary mixtures of coarse ceramic powders were impregnated with an epoxy resin, see Lin et al. "Assessment of Uniformity of Composition Processing" in *Processing of Advanced Ceramics*, pp. 1–18, Soc. Esp. Cerma. Vidir. Arganda del Rey, Madrid, Spain, 1986. After the resin has set, the resin is cut into disc-shaped sections. The sections were subsequently ground, polished and analyzed. This approach has been used on small samples and as described enables assessment of mixing by examination of the local mixture composition.

Numerous steadily rotating mixers have been described, such as rotary kilns, dryers, ball mills and spray coaters. U.S. Pat. No. 4,491,415 describes a pear shaped rotary drum mixing device in which the drum is rotated around a central axis. The drum is supported at an angle of delineation of about 35°. A plurality of radial fins within the drum lift the contents during rotation thereof.

A study of the mixing in the radial phase of a steadily rotating horizontal mixer described that mixing depends on the type and level of loading of the mixture in the horizontal cylinder; see K. W. Carey-Maccauley and M. B. Doruld, *The Mixing Of Solids In Tumbling Mixtures*, Chemical Engineering Science 1964, Vol. 19, pages 191 & 199. The results indicated a steep increase in mixing time as filling of the horizontal cylinders reached the half way mark.

Axially rotating cylinders have the shortcoming that the steady rotation often results in slow mixing and non-uniform distribution of components in the mixer, as described in D. S. Cahn et al, *Nature,* 209 (1966) 494. Horizontal and cylindrical kiln particles tend to move along recirculating flow patterns and can become trapped in dead regions. The trapped particles are slowly blended with the other particles in the system.

The mixing performance of a rotary drum with simultaneous axial rocking motion was described by M. Alonso et al, *Influence of Rocking Motion On The Mixing of Powders, Powder Technology,* 59 (1989) pages 65–67. Mixing in horizontal rotating cylinders was improved when the mixer was rocked back and forth in the axial direction. Relatively high rocking speeds provided high mixing rates regardless of the rotation speed. The temporal variation of the state of mixing was continuously measured by an optical method.

Work in fluid mixing described in M. Liu, F. J. Muzzio and R. L. Pesking, *Quantification of Mixing in Aperiodic Chaotic Flows, Chaos, Solits, Fractals, to appear,* 4(6) :869–893, 1994; D. J. Lamberto, F. J. Muzzio and P. D. Swanson, *Using Time-Dependent RPM To Enhance Mixing In Stirred Vessels, Chemical Engineering Science*, Vol. 51, No. 5, pp. 733–741, 1995 has demonstrated that flow perturbations can be used to enhance mixing performance in industrial equipment. Typical process equipment used in industrial applications used time-periodic or spatially-periodic flows to mix materials (examples of the former are stirred tanks with steadily rotating impellers and also tumbling blenders rotating at constant speed; examples of the later are static mixers and also extruders). In many cases, such periodic flows produce a substantial amount of recirculation, leading to the creation of segregated flow regions and often resulting in incomplete mixing. Liu and Muzzio (1994) used theory and computations to show that the introduction of flow perturbations (and, in particular, perturbations that destroy all flow periodicity) are an effective and robust approach for destroying such segregated patterns, resulting in large mixing enhancements. Lamberto et al. (1995) demonstrated that this method could be used to enhance mixing in liquid mixers of interest to industry. Wightman et al., *A Quantitative Image Analysis Method For Characterizing Mixtures of Granular Materials, Powder Technology* 1995 also demonstrated that the perturbation method is effective in enhancing powder mixing.

It is desirable to provide a system for improved mixing and identifying the mixing characteristics during production.

SUMMARY OF THE INVENTION

Briefly described, the present invention relates to a method and apparatus for mixing particulate solids using disrupted rotational motion. A vessel is rotated around a central axis for producing rotational motion. The vessel is rocked in a direction substantially perpendicular to the central axis for producing rocking motion. For example, the vessel can be a cylinder, double cone, tote, slanted cone, conical hopper and the like. The rocking motion is produced by a profile which periodically disrupts the rotational motion.

In one embodiment, a sinusoidal velocity profile provides time-dependent flow perturbations. Preferably, the rocking frequency is different than the rotational frequency for providing enhanced mixing by reducing resonance effects. Alternatively, the rocking cycle can be varied over time for providing an aperiodic profile. Solidification of the mixed contents of the vessel can be used for identifying mixing characteristics.

In one embodiment, the apparatus can comprise of a vessel rotated by support rollers coupled to a stage. The stage can be lifted for producing the rocking motion. The materials can be loaded into the vessel in either front to back or side to side conditions. Alternatively, rotation of the vessel can be accomplished with a shaft attached to the vessel. The shaft can be rocked to perturb the flow of particles in the vessel. In addition, rotation and rocking motions of the vessel can be implemented with a baffle attached to a rotating bar coaxial to the shaft. The baffle is rotated with a frequency different than that of the vessel. Preferably, the apparatus includes precise independent control of the rotational and rocking motion.

The method and apparatus can be used in industrial applications in which improved mixing provides improved product quality. In addition, the method and apparatus can be used in combination with other industrial applications such as, for example, milling, blending, granulating and coating in which improved mixing improves the industrial applications as well. The invention will be more fully described with reference to the following drawings.

DETAILED DESCRIPTION OF THE PRESENT INVENTION

During the course of this description, like numbers will be used to identify like elements according to the different figures which illustrate the invention.

Figure 1B:
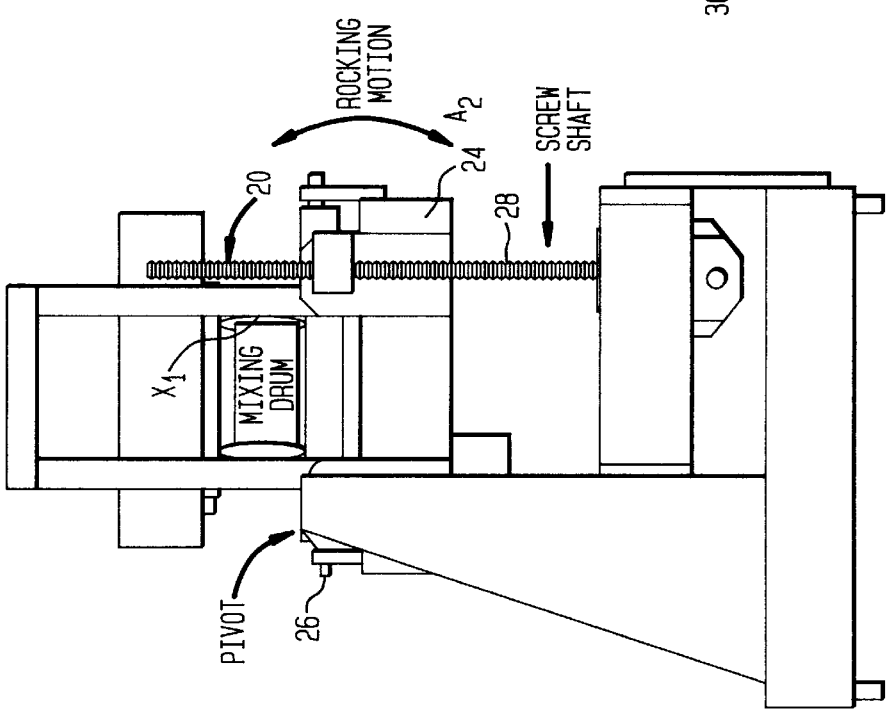
FIG. 1B is a side elevational view of the mixing apparatus shown in FIG. 1A.
Figure 1A:
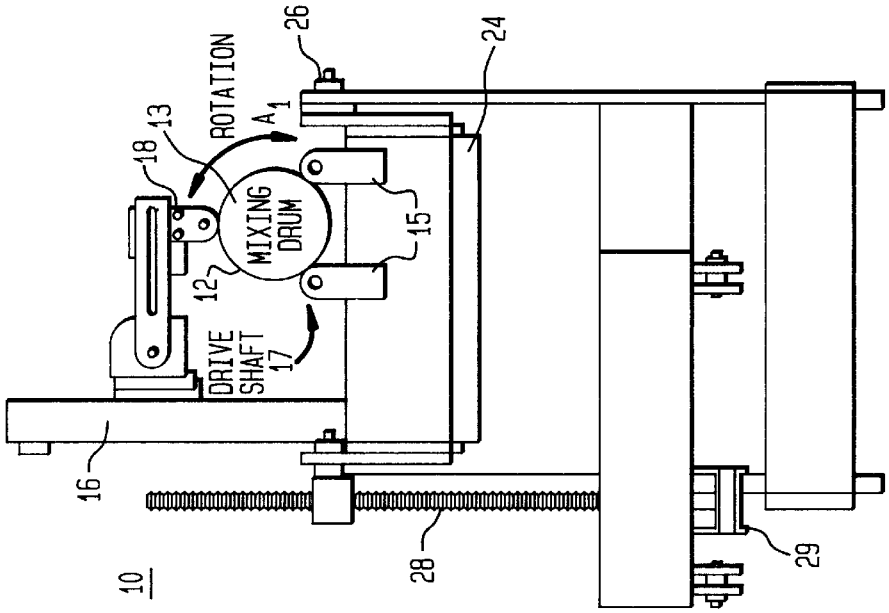
FIG. 1A is a front elevational view of a mixing apparatus in accordance with the teachings of the present invention.

FIGS. 1A and 1B illustrate particulate mixing apparatus 10 in accordance with the teachings of the present invention. A particulate material to be mixed is received in hollow cavity 13 of mixing vessel 12. Mixing vessel 12 can have a variety of shapes, for example, cylinder, double cone, slanted cone, cube, tote, conical hopper and the like. It will be appreciated that other shapes of the mixing vessel can be used in accordance with the teachings of the present invention.

In one embodiment, Mixing vessel 12 can be supported on support rollers 15. Motor 16 drives drive shaft 17 of rollers 15 for producing rotational motion around central axis $X_1$ in the direction of arrow $A_1$. Positioning roller 18 contacts the upper surface of mixing vessel 12 for holding mixing vessel 12 in place on support rollers 15. Positioning roller 18 rotates freely with the rotation of rollers 15.

Mixing vessel 12 is rocked in the direction of arrow $A_2$ with rocking system 20. Rocking system 20 includes stage 24 connected at one end to pivot 26 and at the other end to screw shaft 28. Rollers 15 are coupled to stage 24. Accordingly, stage 24 is parallel to central axis $X_1$ of mixing vessel 12. Motor 29 drives screw shaft 28 to screw and unscrew screw shaft 28 for raising and lowering mixing vessel 12 in the direction substantially perpendicular to the central axis for providing rocking motion in the direction of arrows $A_2$.

The rotational motion and rocking motion are preferably independently controlled with a motor control program interfacing motors 16 and 29. The program synchronizes movement of motors 16 and 29 according to a predetermined profile. For example, motors 16 and 19 can be stepping motors manufactured by Arrick Robotics, Hurst, Tex., coupled to a computer manufactured as Gateway 2000, North Sioux City, S. Dak. A rocking cycle can be defined as movement of stage 24 away from being parallel with central axis $X_1$ and return of stage 24 to be parallel with central axis $X_1$. Rocking cycle parameter $\Omega$ can be defined as the number of rocking cycles per revolution of the rotational motion of mixing vessel 12.

Figure 2A:
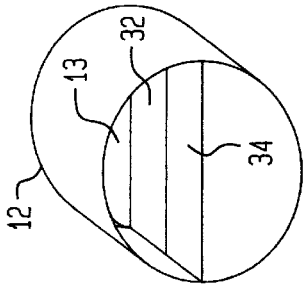
FIG. 2A is a front elevational view of the mixing cylinder in front to back loading condition.
Figure 2B:
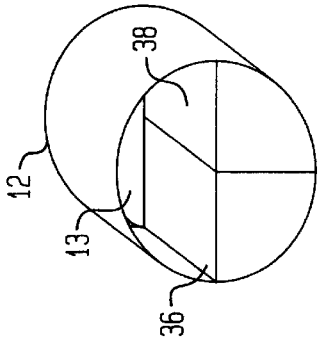
FIG. 2B is a front elevational view of the mixing cylinder in a side by side loading condition.

Mixing vessel 12 can be loaded from front 34 to back 32, as shown in FIG. 2A or side 36 to side 38, as shown in FIG. 2B.

Figure 3:
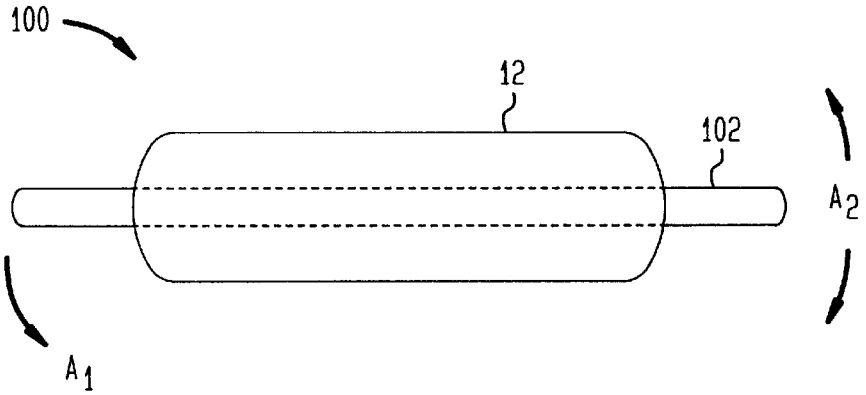
FIG. 3 is a schematic view of an alternate embodiment of the mixing apparatus.

Alternatively, a particulate mixing apparatus 100 can be formed of a mixing vessel 12 including a rotating shaft 102 attached to the vessel, as shown in FIG. 3. An example of this type of mixing apparatus is manufactured as V-Blender or Zig Zag Blender, by Patterson, Kelley, East Stroudsburg, Pa. or as a double cone or slanted cone as manufactured by GEMCO. The rotating shaft 102 provides rotational motion around central axis $X_1$. In the present invention, rotating shaft 102 is rocked to provide rocking motion thereby inducing a flow perturbation. The rocking and rotational motion of the shaft can be accomplished with independently controlled motors as described above.

Figure 4:
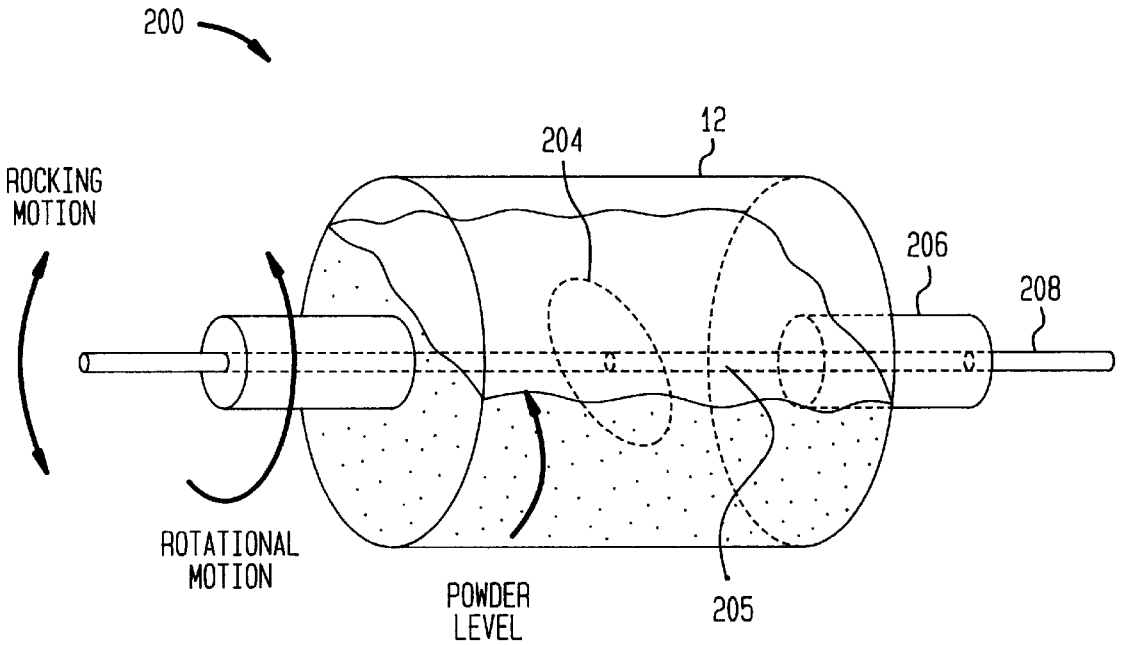
FIG. 4 is a schematic view of an alternate embodiment of the mixing apparatus.

In an alternate embodiment as shown in FIG. 4, particulate mixing apparatus 200 can be formed of mixing vessel 12 having a baffle 204 within vessel 12. Shaft drive 206 drives rotation of vessel 12. Rotating bar 208 which is coaxial with shaft drive 206 is used for driving intensifier bar 205 and baffle 204. Baffle 204 is rotated at a frequency different than the frequency of vessel 12. A motor, such as motor 16 described above, can be attached to shaft drive 206 for providing rotational motion of mixing vessel 12. Rocking motion of mixing vessel 12 can be accomplished with a motor attached to rotating bar 208, such as motor 29 described above, to drive screw shaft 28 for raising and lowering mixing vessel 12. A motor, such as motor 16, can be attached to rotating bar 208 for driving intensifier bar 205 and baffle 204 independently of shaft drive 206. In particulate mixing apparatus 10, 100 and 200 the frequency of the rocking perturbation can be from about 10% to about 1000% of the frequency of the rotation of the vessel. It will be appreciated that other industrial apparatus known in the art could be modified in accordance with the teachings of the present invention to provide a flow perturbation in the rotating vessel.

As discussed in detail below, mixing performance is improved in both front to back and side by side loading conditions for a rocking cycle of $\Omega=1$ in which rocking frequency is identical to the rotational frequency. The identical frequency for both rotational and rocking motion may induce a resonance phenomenon. It has been found that an enhanced mixing characteristics results from a rocking cycle $\Omega$ not equal to one. For example, doubling of the rocking cycle from $\Omega=1$ to $\Omega=2$ significantly enhances mixing. At a rocking cycle of $\Omega=1$, the rocking cycle is equal to the rotation period which may induce a resonance phenomenon resulting in reduced mixing characteristics in comparison with when the rocking and rotation cycles have different frequencies.

It has also been found that mixing enhancement can be achieved for a rocking cycle of less than 1 in which there is less than one rock per revolution, for example, a preferred rocking cycle which is less than one is $\Omega=0.6$. A most preferred rocking cycle is Ω=1.8 which provides enhanced mixing characteristics.

Alternatively, rocking cycle Ω can be varied over time according to an aperiodic profile. For example, rocking cycle Ω may be increased at the start of mixing and reduced after a predetermined number of revolutions.

The mixing structure of the particulate mixture in vessel 12 during mixing can be determined from solidifying the undisturbed mixture inside mixing vessel 12. Preferably, a low viscosity epoxy is injected into hollow cavity 13. For example, a low viscosity epoxy manufactured as Epofix, Struers, Inc. Westlake, Ohio, can be used. The epoxy is dispersed over the mixed particles in hollow cavity 13 and cured. Following solidification, the mixture is extracted from mixing vessel 12, sliced, polished and analyzed for mixing characteristics.

The method and apparatus of the present invention can be used in a variety of production environments such as, for example, mixing, dry and wet milling, wet and dry granulation, chemical reaction, blending, and coating applications. It should be understood that while mixing is sometimes a goal in itself, in most cases, mixing is a component of a process that is performed for other purposes. For example, in spray-coating processes, good mixing throughout the coating process is essential to ensure an efficient process and a high quality product. Efficient mixing inside granulators is critical if one hopes to achieve granulated particles or uniform size. Poor mixing inside mills and often results in low energy efficiency and overly wide particle size distributions. Thus, the present method for improving mixing has the advantage that it can be used to improve mixing and enhance the efficiency and performance of many other processes. For example, improvement of industrial applications can include particle coating in coating pans; wet and dry granulation in high-shear granulators; dry and wet milling processes in ball, bead, and hammer mills; reactions among particles in rotary reactors, combustion processes in rotary calcines and the like.

The following examples will serve to further typify the nature of this invention and should not be construed as a limitation in the scope thereof, which scope is defined solely by the appended claims.

Experimental

Experiment 1

Mixing was performed in mixing apparatus 10 loaded with glass beads in a front to back configuration. The segregated glass beads are 450–600 $\mu$ with a density of 2.46 to 2.49 gcc and are manufactured by Potters Industries Inc., Parsippany, N.J. Different colors of beads were loaded in amounts to fill about 30% of the volume of vessel 12. The mixture was solidified by a low viscosity epoxy, sliced and polished. The vessel is rotated at 5 rpm for 50 revolutions at different rocking frequencies of 1, 2, 0.6 and 1.8.

The results show prior art without rocking (Ω=0) and that rocking cycle Ω=1 has enhanced mixing over prior art mixing completed without rocking. Rocking cycle Ω=1 corresponds to the slowest mixing of the rocking cycle of the invention. Direct observation near the end walls at a rocking cycle Ω=1 shows closed recirculation loop which may provide periodic flow patterns hindering mixing. The results indicate that doubling the rocking frequency from Ω=1.0 to Ω=2 enhances mixing significantly. Rocking cycle Ω=1.8 has greater progress than Ω=2 and yielding nearly heterogenous mixtures in the shortest times observed.

Moderate mixing enhancement is shown in comparison of rocking cycle Ω=0.6 to rocking cycle Ω=1.0.

Experiment 2

Mixing was performed under the same conditions as Experiment 1 in a side by side loading condition for three (3) revolutions. The results show that rocking cycle of Ω=1 has enhanced mixing over prior art rocking cycle Ω=0.

While the invention has been described with reference to the preferred embodiment hereof, it will be appreciated by those of ordinary skill in the art that modification can be made to the structure and form of the invention without departing from the spirit and scope thereof.

We claim:

1. A method for mixing particulate solids comprising the steps of:

rotating a vessel around a central axis for producing rotational motion; and rocking said vessel in a direction substantially perpendicular to said central axis for producing rocking motion, wherein said rocking motion is produced by a profile which periodically disrupts said rotational motion for providing mixing of said particulate solids and said profile is a sinusoidal velocity time profile.

2. The method of claim 1 further comprising the step of: coating said mixed particulate solids.

3. The method of claim 1 further comprising the step of: granulating said mixed particulate solids.

4. The method of claim 1 further comprising the step of: milling said mixed particulate solids.

5. The method of claim 1 further comprising the step of: reacting said mixed particulate solids.

6. A method for mixing particulate solids comprising the steps of:

rotating a vessel around a central axis for producing rotational motion; and rocking said vessel in a direction substantially perpendicular to said central axis for producing rocking motion, said rocking motion is produced by a profile which periodically disrupts said rotational motion for providing mixing of said particulate solids, a rocking cycle Ω is movement of said vessel away from said central axis and return of said vessel to said central axis and said profile is determined from said number of rocking cycles per the number of revolutions of said vessel around said central axis, wherein said rocking cycle Ω is different from said number of revolutions.

7. The method of claim 6 wherein said rocking cycle Ω is greater than one.

8. The method of claim 7 wherein said rocking cycle Ω is equal to about 1.8.

9. The method of claim 6 wherein said rocking cycle Ω is less than one.

10. The method of claim 9 wherein said rocking cycle is equal to about 0.6.

11. The method of claim 6 further comprising the step of: coating said mixed particulate solids.

12. The method of claim 6 further comprising the step of: granulating said mixed particulate solids.

13. The method of claim 6 further comprising the step of: milling said mixed particulate solids.

14. The method of claim 6 further comprising the step of: reacting said mixed particulate solids.

15. A method for mixing particulate solids comprising the steps of:

rotating a vessel around a central axis for producing rotational motion; and rocking said vessel in a direction substantially perpendicular to said central axis for producing rocking motion, wherein said rocking motion is produced by a profile which periodically disrupts said rotational motion for providing mixing of said particulate solids, and said profile is aperiodic.

16. The method of claim 15 further comprising the step of:

coating said mixed particulate solids.

17. The method of claim 15 further comprising the step of:

granulating said mixed particulate solids.

18. The method of claim 15 further comprising the step of:

milling said mixed particulate solids.

19. The method of claim 15 further comprising the step of:

reacting said mixed particulate solids.

20. A method for mixing particulate solids comprising the steps of:

rotating a vessel around a central axis for producing first rotational motion; and rocking said vessel in a direction substantially perpendicular to said central axis for producing rocking motion, said first rotational motion is produced by a shaft drive attached to a first end of said vessel and said rocking motion is produced by a rotating bar coaxial with said shaft drive, said rotating bar being integral with an intensifier bar extending from said first end of said vessel to a second end of said vessel, and a baffle being attached to said intensifier bar for providing second rotational motion, wherein said rocking motion is produced by a profile which periodically disrupts said first rotational motion and said second rotational motion.

21. An apparatus for mixing particulate solids comprising:

vessel means for receiving said particulate solids;

rotating means for rotating said vessel means around a central axis of said vessel means;

rocking means for rocking said vessel means in a direction perpendicular to said central axis; and means for controlling the rocking means with a sinusoidal velocity time profile, wherein said vessel means is rocked by said time profile for periodically disrupting said rotational motion.

22. The apparatus of claim 21 wherein said rotating means comprises:

a pair of lower rollers supporting said vessel; and an upper roller positioned above said vessel.

23. The apparatus of claim 21 further comprising means for controlling said rotating means, wherein and said means for controlling said rotating means and said means for controlling said rocking means comprise a computer controlled stepping motor.

24. An apparatus for mixing particulate solids comprising:

vessel means for receiving said particulate solids;

rotating means for rotating said vessel means around a central axis of said vessel means;

rocking means for rocking said vessel means in a direction perpendicular to said central axis; and means for controlling the rocking means with an aperiodic velocity time profile, wherein said vessel means is rocked by a profile for periodically disrupting said rotational motion.

25. The apparatus of claim 24 wherein said rotating means comprises:

a pair of lower rollers supporting said vessel; and an upper roller positioned above said vessel.

26. The apparatus of claim 24 further comprising means for controlling said rotating means, wherein said means for controlling said rotating means and said means for controlling said rocking means comprise a computer controlled stepping motor.

27. An apparatus for mixing particulate solids comprising:

vessel means for receiving said particulate solids;

rotating means for rotating said vessel around a central axis of said vessel means for providing first rotational motion; and rocking means for rocking said vessel means in a direction perpendicular to said central axis, said rotating means comprises a shaft drive attached to a first end of said vessel and said rocking means comprises a rotating bar coaxial with said shaft drive, said rotating bar being integral with an intensifier bar extending from said first end of said vessel to a second end of said vessel, and a baffle being attached to said intensifier bar, said baffle is rotated with a frequency different than a frequency of said vessel for providing second rotational motion, wherein said vessel is rocked by a profile for periodically disrupting said first rotational motion and said second rotational motion.

* * * * *